US006668845B2

(12) United States Patent
Lin et al.

(10) Patent No.: US 6,668,845 B2
(45) Date of Patent: Dec. 30, 2003

(54) MULTIPLE-FOLD AUTOMATIC UMBRELLA AS ERGONOMICALLY CONSTRUCTED AND MANIPULATED

(75) Inventors: Chung-Kuang Lin, Taipei Hsien (TW); Jung-Jen Chang, Taipei Hsien (TW)

(73) Assignee: Fu Tai Umbrella Works, Ltd., Taipei Hsien (TW)

( * ) Notice: Subject to any disclaimer, the term of this patent is extended or adjusted under 35 U.S.C. 154(b) by 132 days.

(21) Appl. No.: 09/983,846

(22) Filed: Oct. 26, 2001

(65) Prior Publication Data

US 2003/0079765 A1 May 1, 2003

(51) Int. Cl.[7] ..... A45B 25/00

(52) U.S. Cl. ..... 135/29; 135/25.3; 135/23; 135/24; 135/31

(58) Field of Search ..... 135/31, 32, 27, 135/29, 23, 24, 22

(56) References Cited

U.S. PATENT DOCUMENTS

| | | | | | |
|---|---|---|---|---|---|
| 943,068 | A | * | 12/1909 | Friedlaender | 135/31 |
| 1,490,924 | A | * | 4/1924 | Hartzell | 135/25.34 |
| 2,666,442 | A | * | 1/1954 | Fortner | 135/31 |
| 5,337,770 | A | * | 8/1994 | Wang | 135/25.3 |
| 5,467,792 | A | * | 11/1995 | Okuda | 135/25.3 |
| 5,551,463 | A | * | 9/1996 | Wang | 135/25.3 |
| 5,553,634 | A | * | 9/1996 | Yang | 135/25.3 |
| 6,394,115 | B1 | * | 5/2002 | Tsun | 135/25.3 |
| 6,415,805 | B1 | * | 7/2002 | Kuo | 135/22 |
| 6,497,242 | B1 | * | 12/2002 | Lin et al. | 135/31 |
| 2003/0062074 | A1 | * | 4/2003 | Kuo | 135/24 |

FOREIGN PATENT DOCUMENTS

| | | | |
|---|---|---|---|
| FR | 848818 | * | 7/1939 |
| GB | 2188 | * | of 1864 |

* cited by examiner

*Primary Examiner*—Lanna Mai
*Assistant Examiner*—John Fitzgerald
(74) *Attorney, Agent, or Firm*—Troxell Law Office PLLC

(57) ABSTRACT

A multiple-fold automatic umbrella includes: a central shaft, a rib assembly including a top rib, a stretcher rib, at least an intermediate rib and a tail rib pivotally connected one another and pivotally connected to the central shaft, an opening spring, a plurality of closing springs and a control device for controlling the opening and closing of the umbrella; with the intermediate rib formed by extrusion molding process to have a cross section of two-lobe shape having an inner joint and an outer joint respectively connected on opposite ends of the intermediate rib for pivotally connecting inner and outer ribs of the rib assembly for obtaining a light-weight and proper strength of the rib assembly.

5 Claims, 5 Drawing Sheets

566
S5
16
161
231
24
26a
21
4
230
2
22
23
26
23a
1
232
15
14
25
566
564
S4
562
564
S4
562
S3
32
S3
S2
56
S1
S2
S1
17
S5
56
57
572
561
3
565
563
201
573
57
561
20
31
101
50
501
5
52
52s
51
H
121
55
531
13
58
54
10
53
532
11
12

MULTIPLE-FOLD AUTOMATIC UMBRELLA AS ERGONOMICALLY CONSTRUCTED AND MANIPULATED

BACKGROUND OF THE INVENTION

A prior art of U.S. patent application of Ser. No. 09/507, 892 filed on Feb. 22, 2000 (now granted) by the same inventors of this application disclosed a rib assembly for multiple-fold umbrella including a plastic intermediate rib (23) obtained by injection molding process to form a cross section of H shape. The intermediate rib (23) is integrally formed with an inner joint and an outer joint by molding process for pivotally connecting other ribs of the rib assembly. Either inner or outer joint of the intermediate rib (23) should have an "enough" width in order for properly connecting the relevant ribs and therefore can not be minimized to form a slim umbrella rib, thereby causing heavy weight, and inconvenient handling.

Meanwhile, a conventional control means of an automatically opening and closing umbrella including a push button and a rope is not formed as a compact unit and may not be operated quite smoothly.

The present inventor has found the drawbacks of the conventional umbrellas, and invented the present multiple-fold umbrella ergonomically constructed and manipulated.

SUMMARY OF THE INVENTION

The object of the present invention is to provide a multiple-fold automatic umbrella including a central shaft, a rib assembly including a top rib, a stretcher rib, at least an intermediate rib and a tail rib pivotally connected one another and pivotally connected to the central shaft, an opening spring, a plurality of closing springs and a control device for controlling the opening and closing of the umbrella; with the intermediate rib formed by extrusion molding process to have a cross section of two-lobe shape having an inner joint and an outer joint respectively connected on opposite ends of the intermediate rib for pivotally connecting inner and outer ribs of the rib assembly for obtaining a light-weight and proper strength of the rib assembly.

Another object of the present invention is to provide a multiple-fold automatic umbrella including a control device having a multiple-fold rope respectively wound on a plurality of rollers respectively rotatably mounted on a lower runner and an upper notch generally disposed on a single side of the central shaft for an ergonomic assembly and maintenance; and a closing latch pivotally mounted in a push button of the control device, which can be smoothly pivoted and can be biased downwardly by plural tubes of the central shaft when closing the umbrella to prevent from unexpected closing of the umbrella after opening the umbrella.

DETAILED DESCRIPTION

Figure 1:
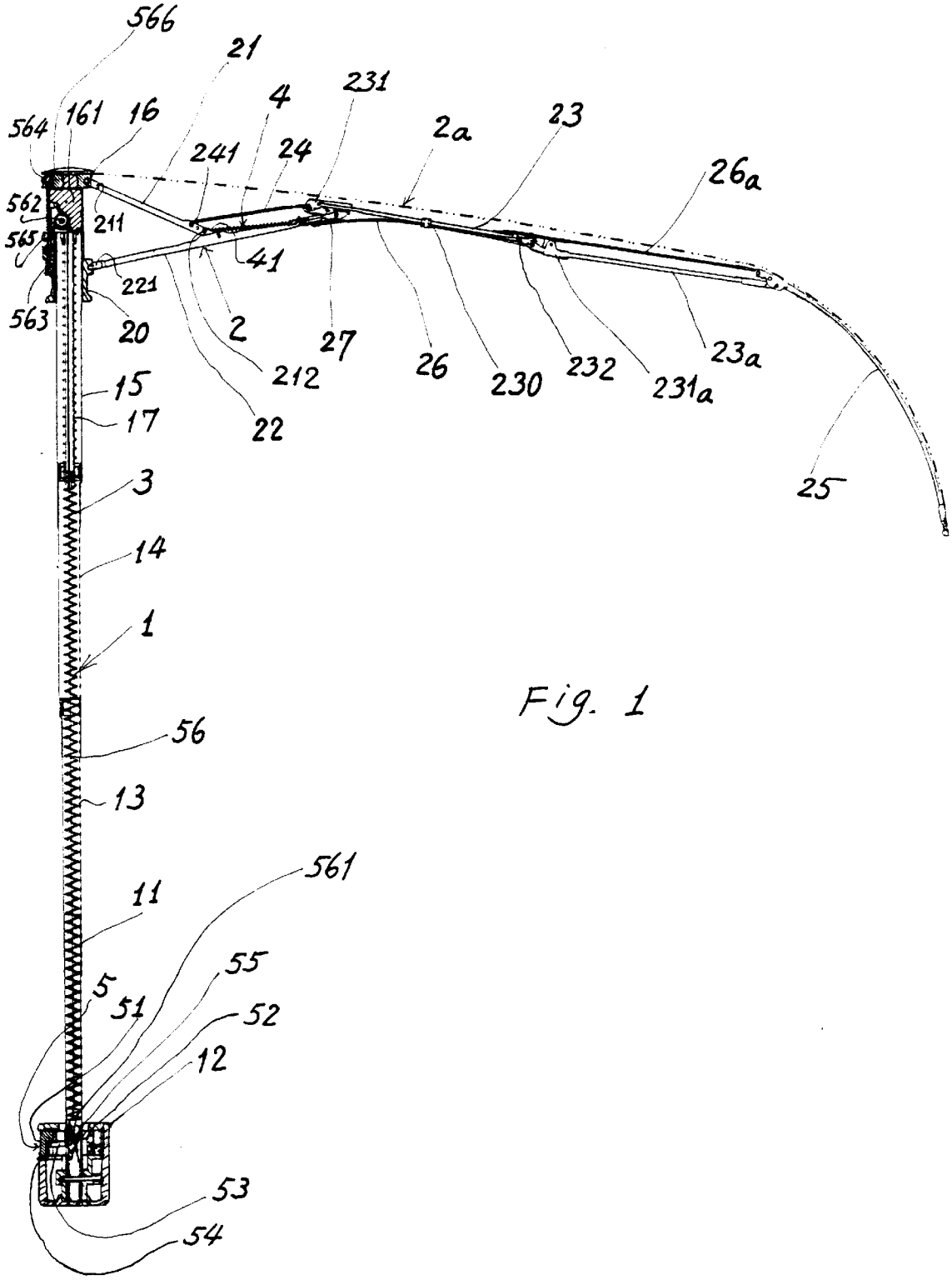
FIG. 1 is an illustration showing an opening umbrella of the present invention.

As shown in the drawing figures, the multiple-fold automatic umbrella of the present invention comprises: a central shaft 1; a rib assembly 2 pivotally secured to the central shaft 1 having an umbrella cloth 2*a* secured on the rib assembly 2; an opening spring 3 retained in the central shaft 1; a plurality of closing springs 4 secured on the rib assembly 2; and a control means 5 majorly formed on the central shaft 1.

The central shaft 1 includes: a lower tube 11 having a grip 12 secured to the lower tube 11, a middle tube 13, an upper tube 14 and an uppermost tube 15 telescopically engaged with one another to form the shaft 1, and an upper notch 16 formed on a top of the shaft 1 having an inner block or inner holder 161 formed in the top of the shaft 1.

The rib assembly 2 includes: a top rib 21 having its inner end 211 pivotally secured to the upper notch 16, a stretcher rib 22 having an inner end 221 pivotally connected to a lower runner 20 slidably held on the shaft 1, an intermediate rib 23 having an inner end of the rib 23 connected with an inner joint 231 which is pivotally connected with an outer end 222 of the stretcher rib 22 and is also pivotally connected to an outer portion of the top rib 21 by a connecting rib 24, a tail (or outer) rib 25 pivotally connected to the intermediate rib 23 by an auxiliary intermediate rib 23*a*, a spring rib 26 juxtapositionally slidably coupled to the intermediate rib 23 by a coupling ring 230, and an auxiliary spring rib 26*a* pivotally connected between the intermediate rib 23 and the tail rib 25.

The present invention may be provided for use as a quadruple-fold umbrella, but may also be used as triple-fold, penta-fold or multiple-fold umbrella, not limited in the present invention.

As to the raw materials for making the ribs of the rib assembly 2, the top rib 21 and the stretcher rib 22 may be made of aluminum alloy; spring ribs 26, 26*a* made of steel; and the tail rib 25 made of reinforced plastics such as FRP or carbon fiber, or metals.

Figure 2:
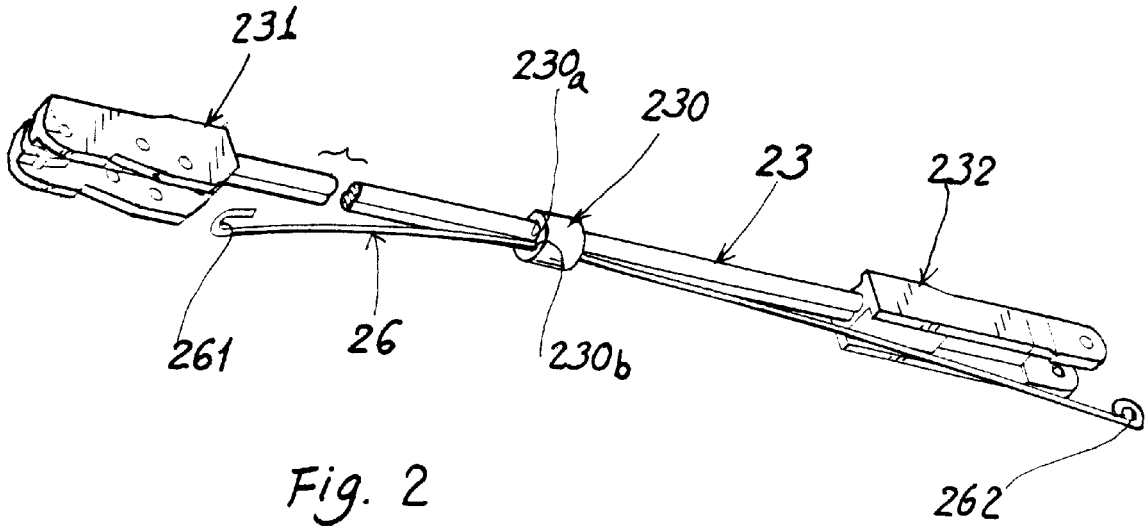
FIG. 2 is a perspective view of the intermediate rib and the spring rib of the present invention.
Figure 3:
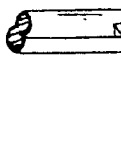
FIG. 3 shows a cross section of the intermediate rib.

The intermediate rib 23 especially as shown in FIGS. 2 and 3 is formed by plastic extrusion molding process to have a cross section of two-lobe shape to reinforce the mechanical strength of the rib 23 and also to smoothen the contour of the rib (due to the lobe shape) without forming acute edge portions of the rib for enhancing the esthetic effect, minimizing volume and weight of the rib, thereby forming a slim compact umbrella.

The intermediate rib 23, after being extruded by extrusion molding process, is then connected with the inner joint 231 and the outer joint 232 on the inner and outer ends of the rib 23 for pivotally connecting the other ribs of the rib assembly 2. Either inner joint 231 or outer joint 232 may be made by plastic injection molding process and then connected with the intermediate rib 23. Therefore, there is no need to prepare a "big" mold for integrally forming the intermediate rib 23 with both joints 231, 232 disposed on opposite ends of the rib 23 as made in the prior art, thereby saving the production cost especially the mold cost.

Figure 5:
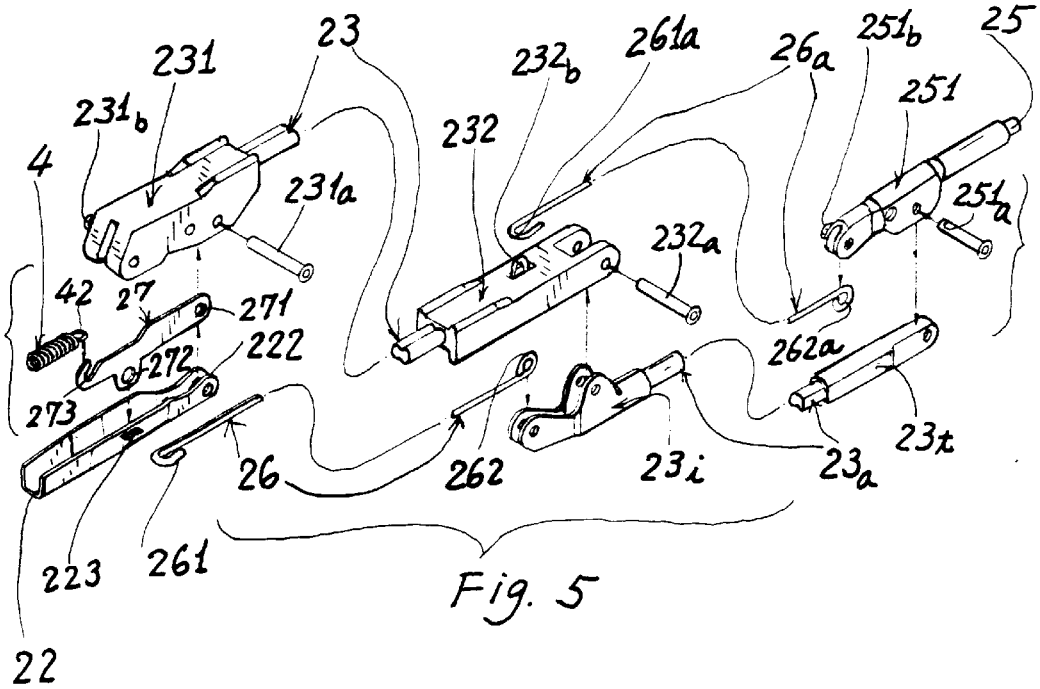
FIG. 5 is a partial perspective view of the intermediate rib with the other ribs of the present invention.
Figure 6:
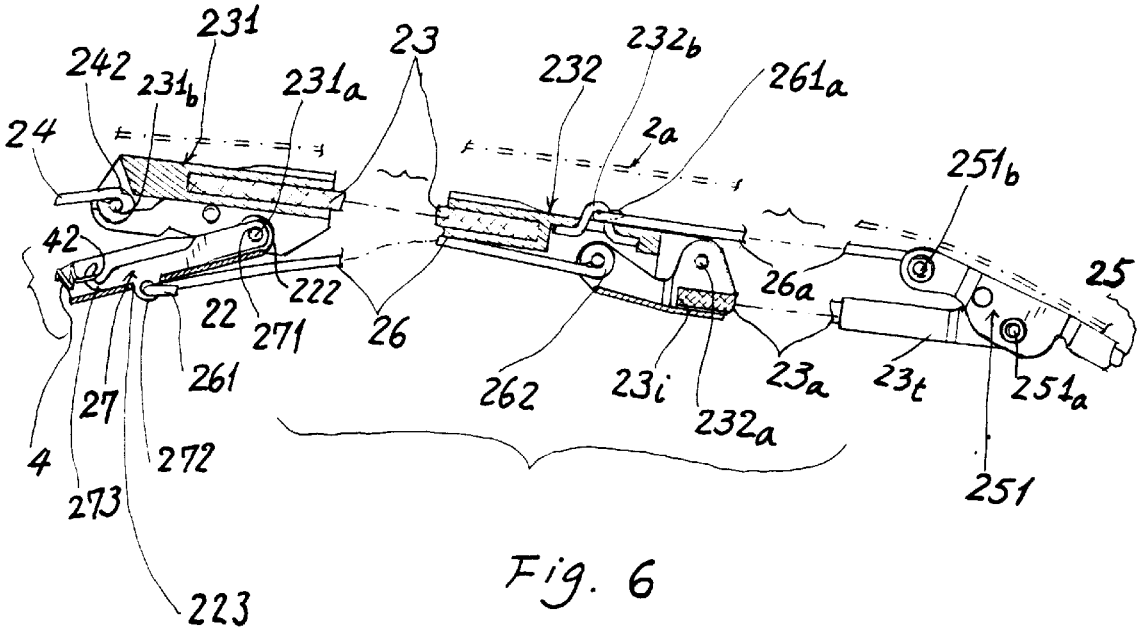
FIG. 6 is a partial sectional drawing of the rib assembly of FIG. 5.

The present invention further comprises a lining bracket 27 formed or embedded in between the inner joint 231 of the intermediate rib 23 and the outer end 222 of the stretcher rib 22 as shown in FIGS. 5, 6. The bracket 27 may be a plate member made by pressing or other mechanical processing methods.

The lining bracket 27 includes: a pivot hole 271 formed in an outer portion of the bracket 27 for pivotally connecting the inner joint 231 with the outer end 222 of the stretcher rib 22 by a pivot 231*a,* a lug 272 protruding downwardly from the bracket 27 through a lug hole 223 formed in an outer portion of the stretcher rib 22 for pivotally connecting an inner end 261 of the spring rib 26, and a hook portion 273 formed on an inner portion of the bracket 27 for fastening an outer spring end 42 of the closing spring 4 of which an inner spring end 41 is secured to an outer portion 212 of the top rib 21.

The lining bracket 27 plays a plurality of roles and functions as follows:

1. Providing means for pivotally connecting plural ribs 26, 22, 23 within the narrow or tiny area among those ribs;
2. Fastening the closing spring 4 without obstructing the pivotal connection of the relevant ribs of the rib assembly 2;
3. Reinforcing the joining parts including the intermediate rib 23, the stretcher rib 22 and the spring rib 26 since the bracket 27 is provided at a central position in the inner joint 231 and the outer portion of the stretcher rib 22 for preventing twisting or deformation of the ribs.

The outer joint 232 of the intermediate rib 23 is pivotally connected with an inner end 23*i* of the auxiliary intermediate rib 23*a* by a pivot 232*a* and the outer joint 232 is also pivotally connected with an inner end 261*a* of the auxiliary spring rib 26*a* by a collar 232*b;* with the inner end 23*i* of the auxiliary intermediate rib 23*a* also pivotally connected with an outer end 262 of the spring rib 26; with the outer joint 232 having a bottom interior provided for stably accommodating the inner end 23I of the auxiliary intermediate rib 23*a* and the outer end 262 of the spring rib 26 for resisting wind force impacting the umbrella cloth and ribs.

The auxiliary intermediate rib 23*a* may also be made by plastic extrusion process having a cross section with upper convex portion and bottom concave portion as shown in FIG. 5, but the shapes of the rib 23*a* being not limited in this invention.

The tail rib 25 has an inner joint 251 pivotally connected with an outer end 23*t* of the auxiliary intermediate rib 23*a* by a pivot 251*a,* and also pivotally connected with an outer end 262*a* of the auxiliary spring rib 26*a* by a pivot 251*b.*

Figure 4:
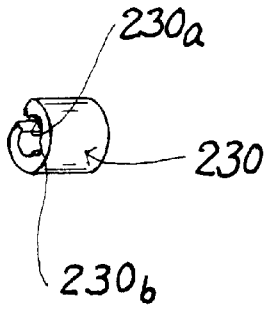
FIG. 4 shows the coupling ring adapted for coupling the intermediate rib with the spring rib.

The coupling ring 230 is formed with a two-lobe hole 230*a* to be engaged with the intermediate rib 23 having the cross section of two-lobe shape, and also formed with a round hole 230*b* in the ring 230 juxtapositioned to the two-lobe hole 230*a* for slidably engaging the spring rib 26 with the round hole 230*b* as shown in FIGS. 2, 4.

The opening spring 3 for opening the umbrella has a lower spring end 31 retained at a lower portion of the central shaft 1 with the spring 3 disposed around an inner sleeve 17 secured to the inner block 161 of the shaft 1, and an upper spring end 32 retained against the inner block 161.

Each closing spring 4 has its inner spring end 41 pivotally connected with the top rib 21 and an outer spring end 42 secured to the lining bracket 27 for pivotally connecting the intermediate rib 23, the stretcher rib 22 and the spring rib 26 for smoothening the umbrella-closing operation.

Figures 7, 8:
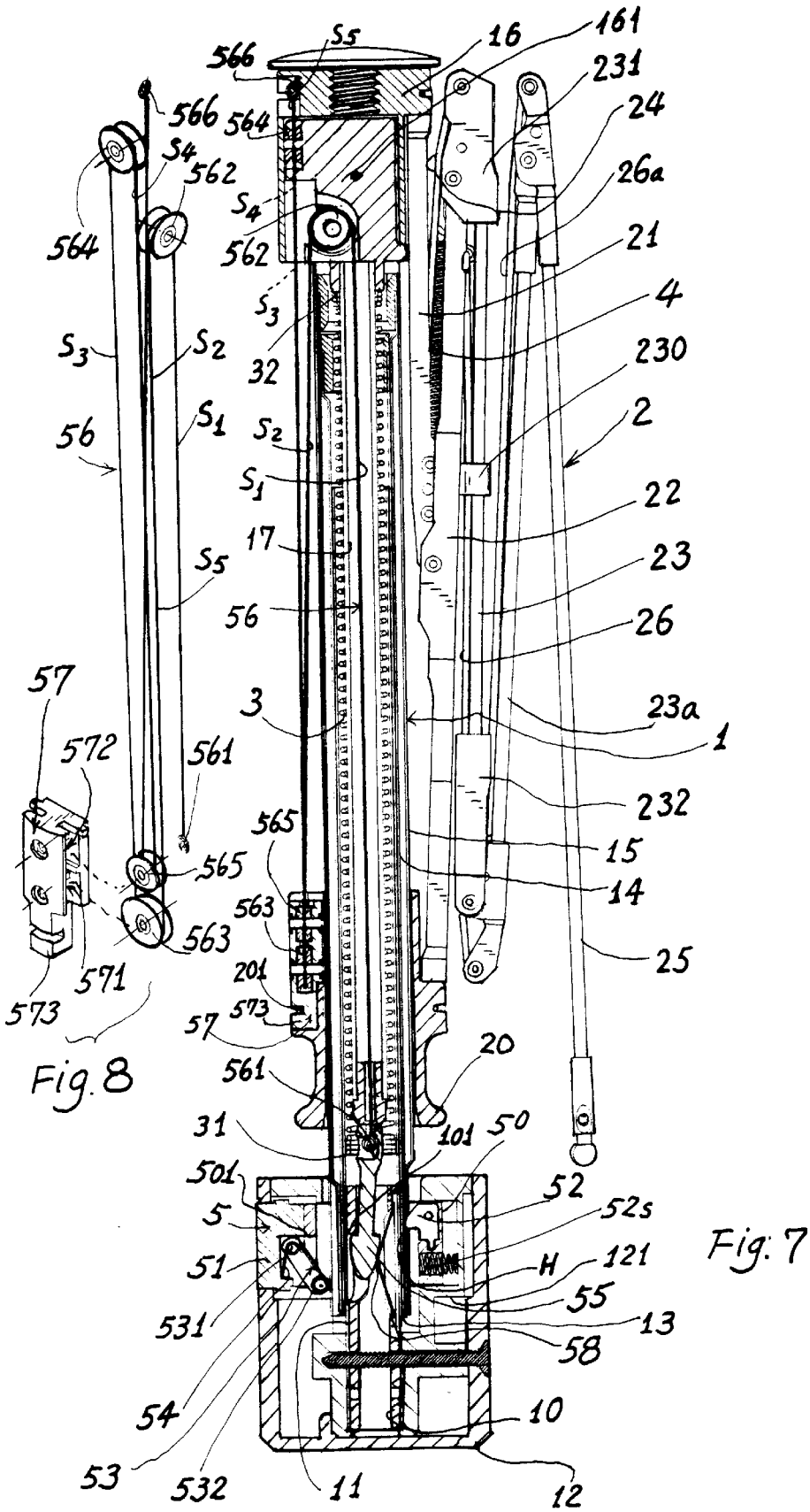
FIG. 7 is a sectional drawing of the present invention when closed.
FIG. 8 is an illustration showing the guiding rollers and the rope of the present invention.

The control means 5 includes: a push button 51 slidably held in the grip 12 and contacted with a sliding ring 50 slidably held in a base holder 121 fixed in the grip 12; an opening latch 52 fixed in an upper portion of the sliding ring 50 for engaging a latch hole H respectively formed in the tubes 13, 14, 15 of the shaft 1 when closing the umbrella as shown in FIG. 7; a tension spring 52*s* retained between the sliding ring 50 and the base holder 121 for normally urging the sliding ring 50 and the push button 51 outwardly ready for a depression on the push button 51; whereby upon depression of the push button 51 to disengage the opening latch 52 from the latch hole H, the opening spring 3 will extend the tubes of the shaft 1 and the rib assembly 2 for opening the umbrella; a closing latch 53 pivotally mounted in the push button 51 by a pivot 531 having an arcuate shoulder portion 532 or 532*a* formed on an actuating end of the closing latch 53, with the closing latch 53 normally horizontally lifted as restored by a restoring spring 54 retained in the button 51 to be retarded on a latch hole 501 formed in the sliding ring 50 (FIG. 10), whereby upon closing of the umbrella to fold and lower the tubes 15, 14, 13 of the central shaft 1, the closing latch 53 will be downwardly biased by the ends of the tubes 15, 14, 13 (FIG. 7) to prevent from unexpected umbrella-closing operation after depressing the push button 51 for opening umbrella (FIG. 9); and a locking head 55 secured with a rope 56 directed through an interior in the central shaft 1 and the lower runner 20 towards the upper notch 16 of the shaft 1, with the locking head 55 engaged with an engaging hole 101 formed in a lower inner sleeve 10 fixed in the lower tube 11 in the grip 12 when closing the umbrella (FIG. 7).

Upon closing the umbrella, the push button 51 is depressed inwardly to allow the closing latch 53 to thrust the locking head 55 to be disengaged from the engaging hole 101, the closing springs 4 will restore to close the umbrella from FIG. 1 to FIG. 10. After re-setting the folded umbrella from FIG. 10 to FIG. 7 by compressing the tubes of the shaft 1 and the opening spring 3, the locking head 55 as guided by the convex spring plate 58 will be re-engaged with the hole 101 for completely closing and folding the umbrella.

Figure 9:
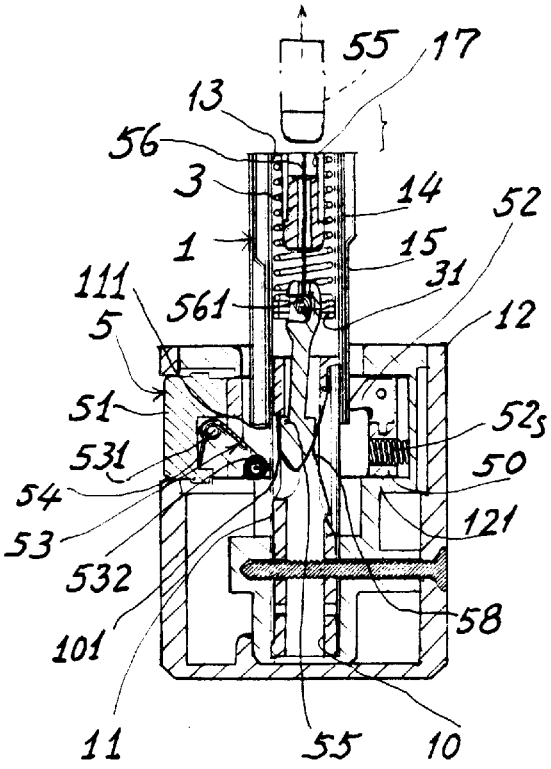
FIG. 9 is a sectional drawing showing the depression of the push button for opening the present invention.
Figure 10:
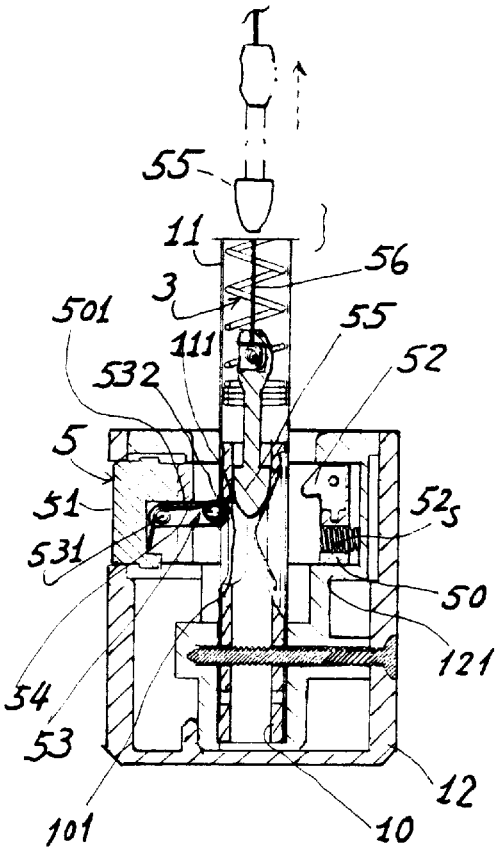
FIG. 10 shows the closing operation of the control means from an opening umbrella.

The arcuate shoulder portion 532 (as shown in FIGS. 7, 9) of the closing latch 53 is formed by rotatably mounting a miniature roller on the actuating end of the closing latch 53, whereby upon closing of the umbrella by lowering the tubes of the shaft 1 to downwardly bias the latch 53, the miniature roller 532 on the latch 53 will provide a rolling contact with the tube surface of the tube of the central shaft, thereby preventing from noise pollution caused from the closing (or opening) operation of the umbrella. Meanwhile, the roller 532 as giving a smooth rolling contact between the latch 53 and the shaft, the rising of the tubes of the shaft 1 when opening the umbrella (from FIG. 9 to FIG. 10 or FIG. 1) will not be retarded by the latch 53 even under a resilience of the restoring spring 54 of the latch 53 (Note: The spring force of the restoring spring 54 is greatly smaller than that of the opening spring 3).

Figure 11:
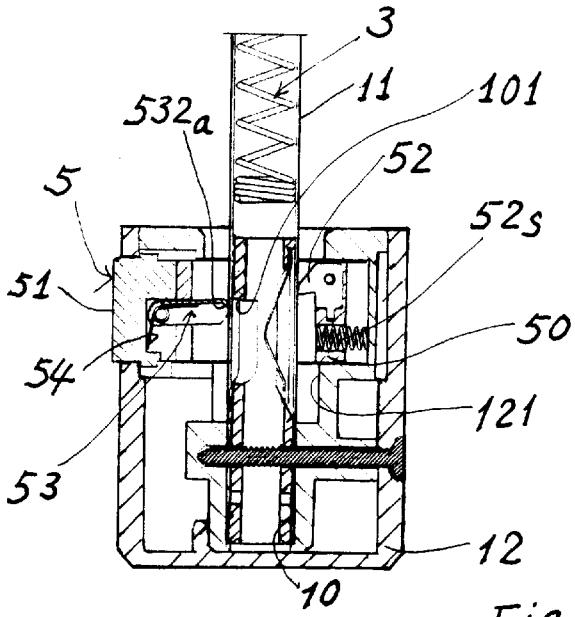
FIG. 11 shows a folded umbrella of the present invention having the closing latch slightly modified.

The arcuate shoulder portion of the closing latch 53 may also be modified as a simple arcuate surface 532*a* as shown in FIG. 11 to further simplify the construction of the present invention.

The rope 56 as shown in FIGS. 1, 7 and 8 includes: an inner rope end 561 secured to the locking head 55; a first upper guiding roller 562 rotatably mounted in the inner holder (or block) 161 for winding the first rope section S1 from the inner rope end 561; a first lower guiding roller 563 rotatably mounted in a first cavity 571 formed in a lower guiding-roller holder 57 provided in the lower runner 20 for winding a second rope section S2 as directed from the first upper guiding roller 562; a second upper guiding roller 564 rotatably mounted in the inner holder 161(positioned above the first upper guiding roller 562) for winding the third rope section S3 as led from the first lower guiding roller 563; a second lower guiding roller 565 rotatably mounted in a second cavity 572 formed in the lower guiding-roller holder 57 for winding the fourth rope section S4 as directed from the second upper guiding roller 564; and a fifth rope section S5 directed from the second lower guiding roller 565 towards the outer rope end 566 fixed in the inner holder (or block) 161 or in the upper notch 16, thereby forming a penta-fold rope (S1~S5) or multiple-fold rope.

The number of rollers, the rope sections and folds of the rope are not limited in this invention. The penta-fold rope 56 as illustrated may be used for quadruple-fold, penta-fold or any other multiple-fold umbrella.

The rollers are generally disposed on a single (left of right) side of the central shaft 1 for an easier assembly and maintenance of the present invention. The lower guiding-roller holder 57 further includes an extension plate 573 protruding downwardly from the holder 57 to be firmly secured on the lower runner 20 by a fastening wire 201.

The construction of the elements of the present invention as well as the manipulation of the umbrella of this invention are so ergonomic, thereby being superior to the prior arts of conventional multiple-fold automatic umbrellas including the multiple-fold umbrellas.

The present invention may be modified without departing from the spirit and scope of the present invention. The rib assembly of the present invention may also be used for multiple-fold umbrella, besides the multiple-fold automatic umbrella.

We claim:

1. A multiple-fold automatic umbrella comprising:

a central shaft including a plurality of tubes telescopically engageable with one another;

a rib assembly having an umbrella cloth secured thereon and including at least a top rib pivotally secured to an upper notch of the shaft, a stretcher rib pivotally connected with said top rib and a lower runner slidably held on said shaft, an intermediate rib connectable to said stretcher rib and said top rib, and a tail rib connectable to said intermediate rib;

an opening spring retained in said shaft for opening the umbrella;

a plurality of closing springs retained on said rib assembly for closing the umbrella; and a control means including at least a push button formed in a grip of said shaft, and a rope directed through an interior in said shaft, said lower runner and said upper notch on said shaft;

said intermediate rib made of plastic and reinforced plastic materials by extrusion molding to have a cross section of two-lobe shape;

said rib assembly further including said intermediate rib having an inner end thereof connected with an inner joint which is pivotally connected with an outer end of the stretcher rib and is pivotally connected to an outer portion of the ton rib by a connecting rib, said tail rib pivotally connected to the intermediate rib by an auxiliary intermediate rib which is pivotally connected to an outer joint of said intermediate rib, a spring rib juxtapositionally slidably coupled to the intermediate rib by a coupling ring, and an auxiliary spring rib pivotally connected between the intermediate rib and the tail rib; with a lining bracket formed between said inner joint of said intermediate rib and an outer portion of said stretcher rib;

said lining bracket including a pivot hole formed in an outer portion of the bracket for pivotally connecting the inner joint with the outer end of the stretcher rib by a pivot, a lug protruding downwardly from the bracket through a lug hole formed in an outer portion of the stretcher rib for pivotally connecting an inner end of the spring rib, and a hook portion formed on an inner portion of the bracket for fastening an outer spring end of the closing spring of which an inner spring end is secured to an outer portion of the to rib; and said outer joint of the intermediate rib pivotally connected with an inner end of the auxiliary intermediate rib and the outer joint pivotally connected with an inner end of the auxiliary spring rib by a collar; with the inner end of the auxiliary intermediate rib pivotally connected with an outer end of the spring rib; and with the outer joint having a bottom interior provided for accommodating the inner end of the auxiliary intermediate rib and the outer end of said spring rib.

2. An automatic umbrella according to claim 1, wherein said coupling ring is formed with a two-lobe hole to be engaged with the intermediate rib having a cross section of two-lobe shape, and formed with a round hole in the coupling ring juxtapositioned to the two-lobe hole for slidably engaging the spring rib with the round hole.

3. An automatic umbrella according to claim 1, wherein said control means includes: a push button slidably held in the grip and contacted with a sliding ring slidably held in a base holder fixed in the grip; an opening latch fixed in an upper portion of the sliding ring for engaging a latch hole respectively formed in the tubes of the shaft when closing the umbrella; a tension spring retained between the sliding ring and the base holder for normally urging the sliding ring and the push button outwardly ready for a depression on the push button; a closing latch pivotally mounted in the push button having an arcuate shoulder portion formed on an actuating end of the closing latch, said closing latch operatively biased downwardly by the tubes of said shaft when closing the umbrella; and a locking head secured with said rope directed through the interior in the central shaft and the lower runner towards the upper notch of the shaft with the locking head engaged with an engaging hole formed in a lower inner sleeve fixed in the lower tube in the grip when closing the umbrella.

4. An automatic umbrella according to claim 3, wherein said closing latch includes a miniature roller rotatably mounted in the actuating end of said closing latch to form said arcuate shoulder portion of said closing latch.

5. An automatic umbrella according to claim 3, wherein said rope includes: an inner rope end secured to the locking head; a first upper guiding roller rotatably mounted in an inner holder in an upper portion of said shaft for winding a first rope section from the inner rope end; a first lower guiding roller rotatably mounted in a lower guiding-roller holder provided in the lower runner for winding a second rope section as directed from the first upper guiding roller; a second upper guiding roller rotatably mounted in the inner holder for winding a third rope section as led from the first lower guiding roller; a second lower guiding roller rotatably mounted in the lower guiding-roller holder for winding a fourth rope section as directed from the second upper guiding roller; and a fifth rope section directed from the second lower guiding roller towards an outer rope end fixed in the inner holder adjacent to the upper notch, thereby forming a multiple-fold rope.

* * * * *